US005117345A

United States Patent [19]

Baake

[11] Patent Number: 5,117,345

[45] Date of Patent: May 26, 1992

[54] PORTABLE LAMP

[75] Inventor: Karl A. Baake, Angola, N.Y.

[73] Assignee: K & H Industries, Inc., Angola, N.Y.

[21] Appl. No.: 585,233

[22] Filed: Sep. 19, 1990

[51] Int. Cl.[5] ..... F21V 15/04

[52] U.S. Cl. ..... 362/390; 362/216; 362/223; 362/400

[58] Field of Search ..... 362/185, 186, 216, 217, 362/376, 378, 390, 399, 400, 223; D26/42

[56] References Cited

U.S. PATENT DOCUMENTS

| | | | |
|---|---|---|---|
| D. 301,631 | 6/1989 | Leung | D26/42 |
| 2,691,092 | 10/1954 | McConnell et al. | 362/223 |
| 3,154,252 | 10/1964 | Baake | 362/222 |
| 4,262,327 | 4/1981 | Kovacik et al. | 362/223 |

*Primary Examiner*—Stephen F. Husar
*Attorney, Agent, or Firm*—Hodgson, Russ, Andrews, Woods & Goodyear

[57] ABSTRACT

A portable electric lamp of explosion-proof construction including an elongated hand grip, an elongated flourescent bulb having a U-shaped light-generating portion supported at one end of the hand grip and a transparent tube positioned about the light-generating portion of the bulb utilizes an elongated tubular protector element positioned about the transparent tube and which cooperates with the hand grip to maintain the transparent tube in position about the light-generating portion of the bulb. The lamp further includes a power cord routed through the end of the hand grip opposite the light-generating portion and the lamp includes an amount of magnesite base cement positioned in the hand grip and interposed between the light-generating portion and a section of the power cord entering the hand grip. The lamp further includes a ballast assembly having a ballast interconnected in the power cord at a location remote of the hand grip and wherein the ballast is encased in magnesite base cement.

2 Claims, 4 Drawing Sheets

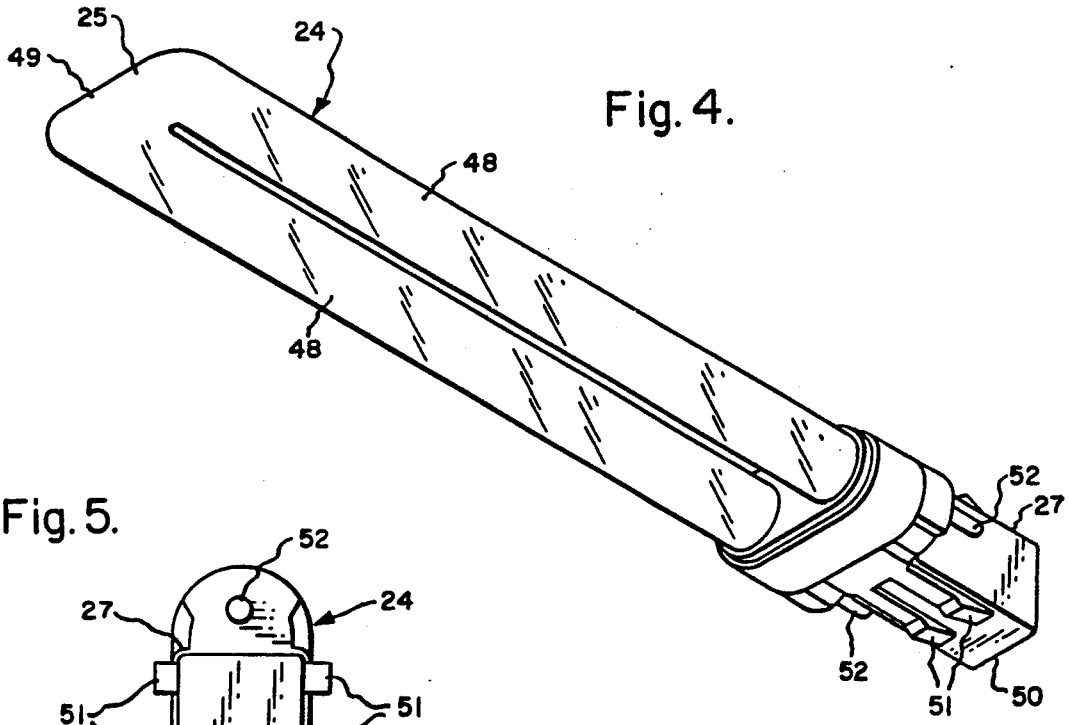
Fig. 4.
Fig. 5.
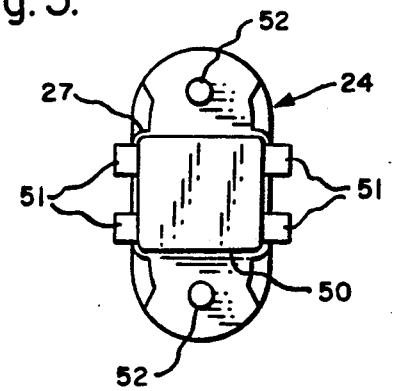
Fig. 7.
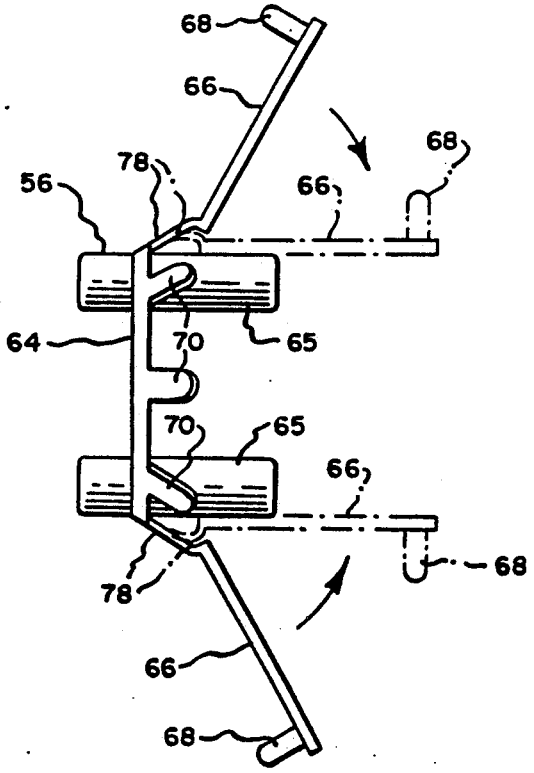
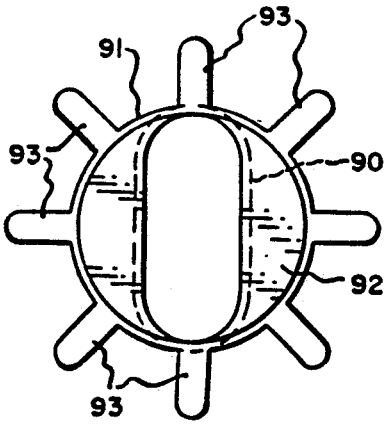
Fig. 8.

Fig. 11.
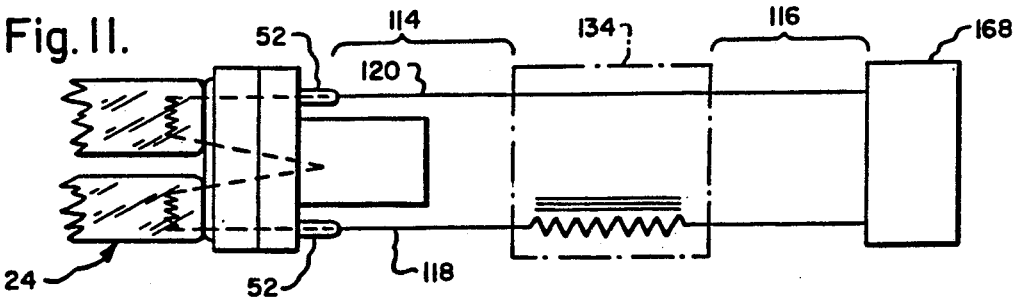
Fig. 12.
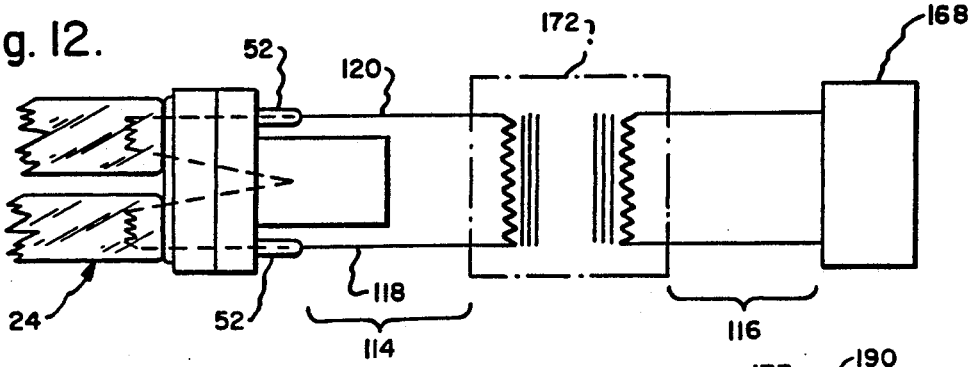
Fig. 15.
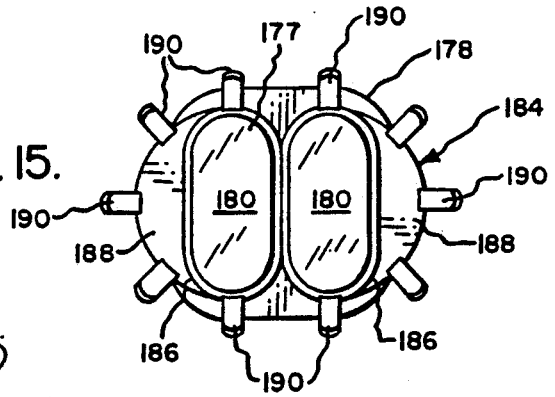
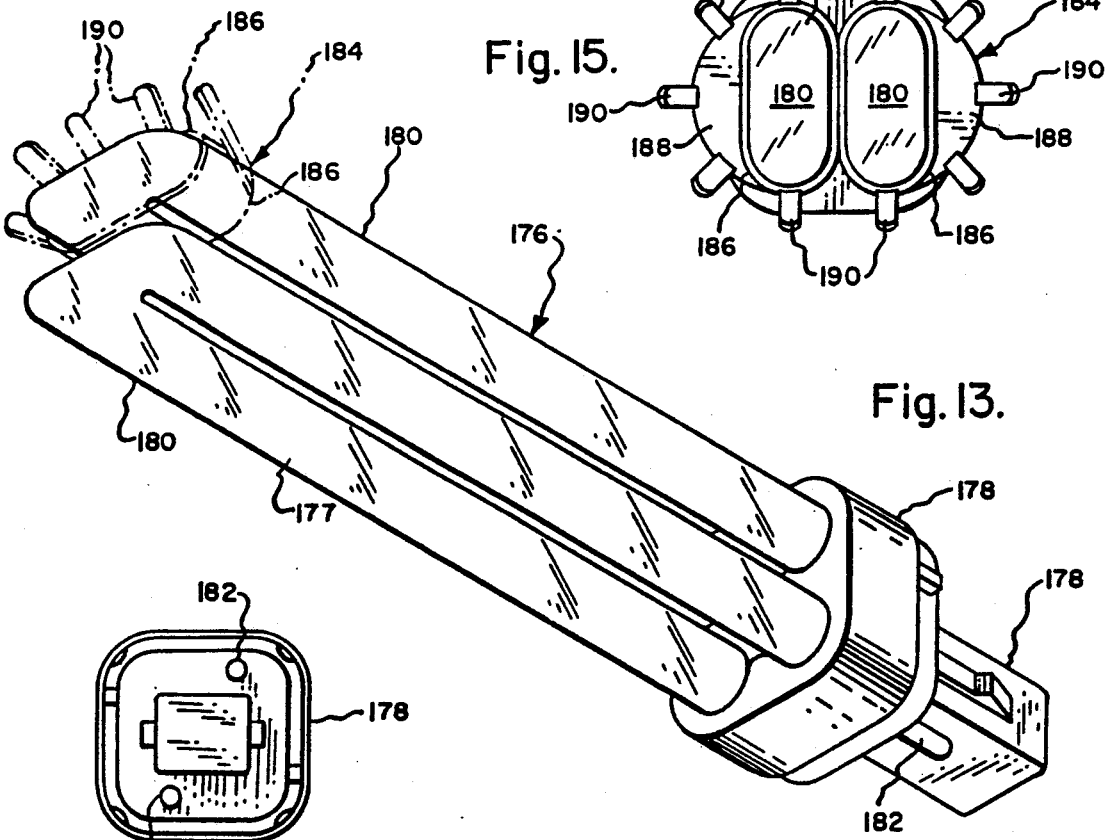
Fig. 13.
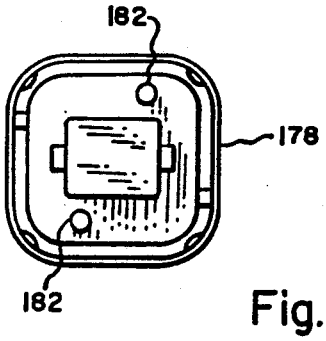
Fig. 14.

PORTABLE LAMP

BACKGROUND OF THE INVENTION

This invention relates to the art of electric lamps, and more particularly to a new and improved portable electric lamp of explosion-proof construction.

The lamp with which this invention is concerned is of a type commonly used for illuminating mines or similar work environments containing explosive gases. In order that the lamp satisfy safety requirements of mines and other such working areas, the lamp must be of explosion-proof construction. In particular, such lamps should be adequately enclosed or sealed against entry of explosive gas, should be of a construction which limits or confines any internal explosion and its effects in the event that one does occur in the lamp, and should withstand impacts and shocks to which the lamp is exposed if dropped or bumped. An example of the lamp of a aforedescribed type is shown and described in U.S. Pat. No. 4,156,893 having the same inventor as the present invention.

It is an object of the present invention to provide a new and improved portable electric lamp of the aforedescribed type.

Another object of the present invention is to provide such a lamp having an improved explosion-proof construction.

Still another object of the present invention is to provide such a lamp capable of providing a large amount of light relative to the length of the lamp.

Yet still another object of the present invention is to provide such a lamp which is relatively light in weight.

A further object of the present invention is to provide such a lamp which is relatively inexpensive to construct and which has components which can be fabricated with relative ease.

A still further object of the present invention is to provide such a lamp having a construction which is highly resistant to impact and similar shocks.

A yet still further object of the present invention is to provide such a lamp having an electric bulb and improved means for protecting the bulb.

One more object of the present invention is to provide such a lamp which is relatively short in length rendering it easy to use in relatively confined areas.

Still one more object of the present invention is to provide such a lamp which is uncomplicated in construction and easy to service.

SUMMARY OF THE INVENTION

This invention resides in a portable electric lamp of explosion-proof construction.

The lamp includes an elongated electric bulb, an elongated hand grip, and means for supporting the bulb at one end of the hand grip. The bulb has a light-generating portion at one end of the bulb and a current-receiving portion at the other end of the bulb, and the bulb-supporting means is adapted to cooperate with the current-receiving portion of the electric bulb to thereby maintain the bulb in such a relationship with the hand grip that the light-generating portion of the bulb extends axially of and from one end of the hand grip. The lamp further includes an elongated transparent tube positioned about the light-generating portion of the electric bulb and which is transparent to light generated thereby. An elongated tubular protector element having a protector body is positioned about the transparent tube and cooperates with the hand grip to maintain the transparent tube in position about the light-generating portion of the electric bulb. The protector body defines a side opening therein through which light generated by the light-generating portion of the bulb is transmitted out of the protector element, and the lamp further includes conducting means operatively connected to the bulb-supporting means for routing current from a power source to the current-receiving portion of the bulb.

In one aspect of the invention, the conducting means includes a power cord routed through the end of the hand grip opposite the light-generating portion of the bulb for supplying power to the bulb, and the lamp further includes an amount of magnesite base cement positioned in the hand grip and interposed between the light-generating portion and a section of the power cord entering the hand grip. In another aspect of the invention, the bulb is a fluorescent type and the lamp further includes a ballast assembly including a ballast operatively interconnected in the conducting means of the lamp wherein the ballast is encased in magnesite base cement. In still another aspect of the inventor, the light-generating portion of the bulb is U-shaped so that the light emitted by the bulb is relatively great as measured per unit length of the light-generating portion.

BRIEF DESCRIPTION OF THE DRAWING FIGURES

FIG. 4 is a perspective view of the bulb of the FIG. 1 lamp.

FIG. 5 is a view of the current-receiving portion of the FIG. 5 bulb as the bulb is viewed endwise and theretoward.

FIG. 7 is a side elevation view of a bulb-receiving component of the FIG. 1 lamp similar to the showing of the component in FIG. 2 but drawn to a slightly larger scale.

FIG. 8 is a view of the bulb and a shock absorbing device of the FIG. 1 lamp as seen along lines 8—8 of FIG. 2.

FIG. 11 is a view showing in block diagram form the wiring of the FIG. 1 lamp.

FIG. 12 is a view similar to that of FIG. 11 illustrating the wiring of an alternative lamp in accordance with the present invention.

FIG. 13 is a perspective view similar to that of FIG. 4 of a bulb for another lamp in accordance with the present inventor.

FIG. 14 is an end view similar to that of FIG. 5 of the FIG. 13 bulb.

FIG. 15 is a view similar to that of FIG. 8 of the FIG. 13 bulb having shock-absorbing devices operatively positioned thereabout.

DETAILED DESCRIPTION OF THE ILLUSTRATED EMBODIMENTS

Figure 1:
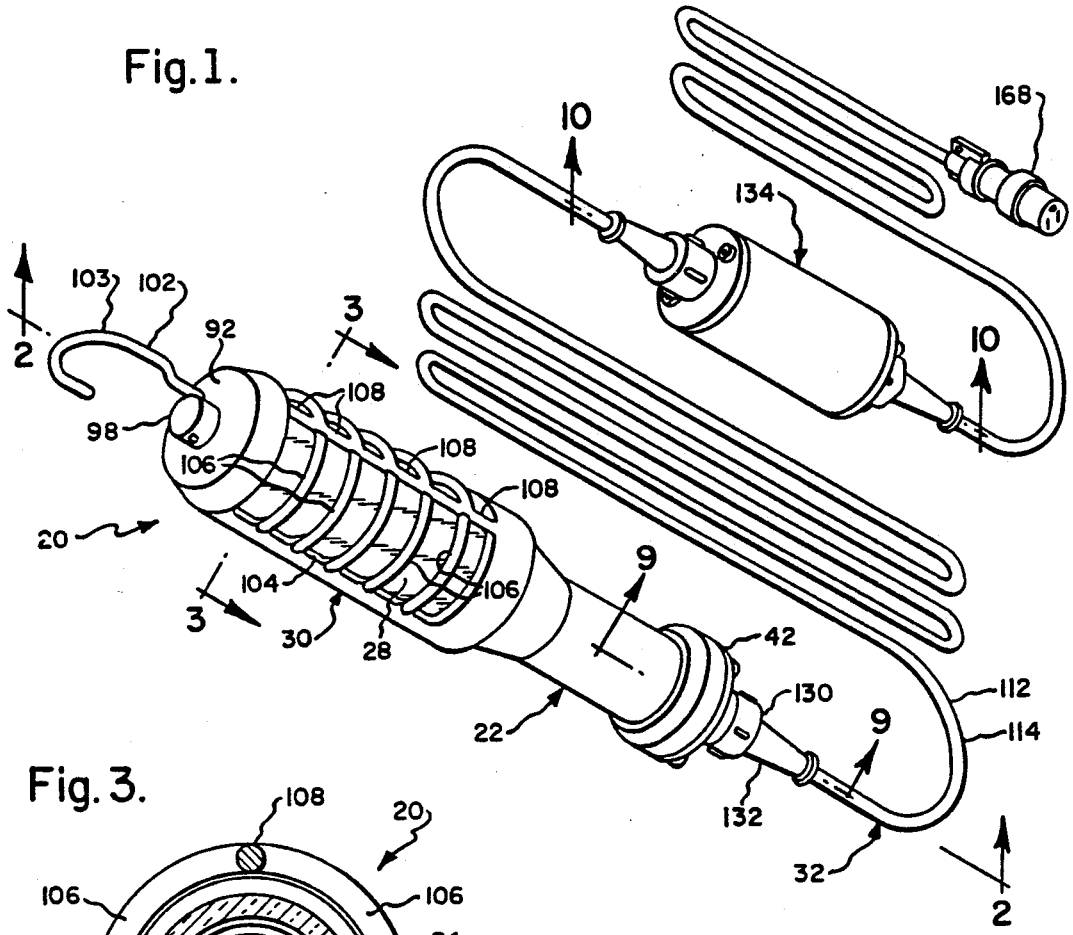
FIG. 1 is a perspective view of an embodiment of a portable lamp in accordance with the present invention.
Figure 2:
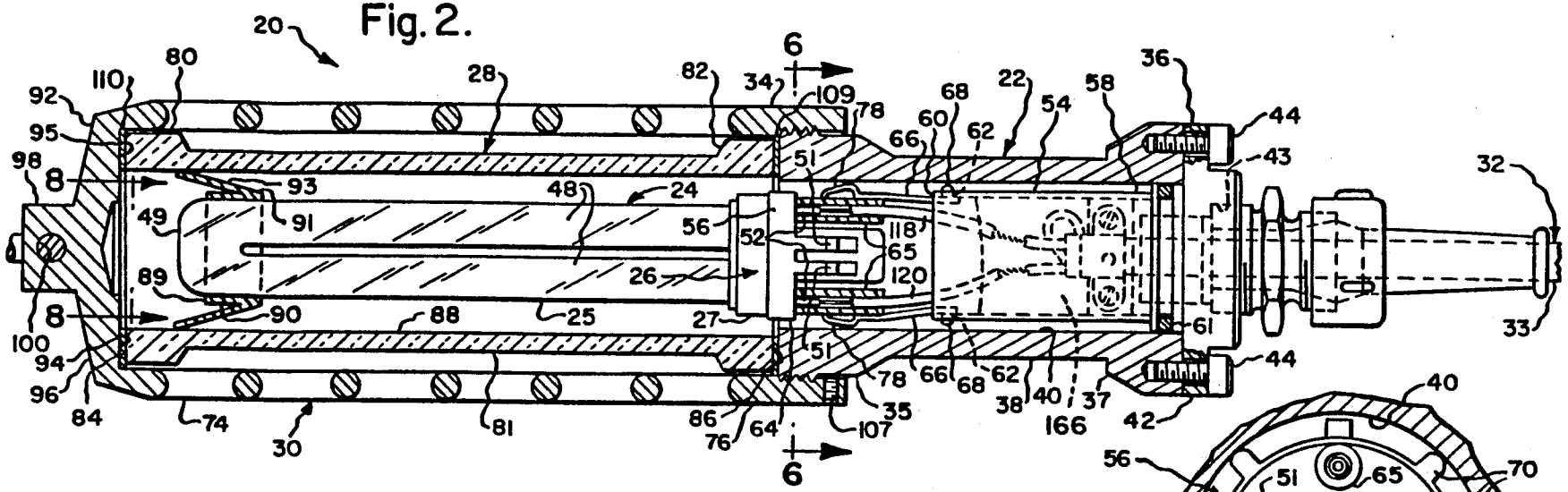
FIG. 2 is a cross-sectional view of the FIG. 1 lamp taken about on lines 2—2 of FIG. 1.

Turning now to the drawings in greater detail and considering first FIGS. 1 and 2, there is illustrated a portable electric lamp, generally indicated 20, in accordance with the present invention. The lamp 20 is of explosion-proof construction and is highly resistant to impacts or shocks to which the lamp may be exposed if dropped or bumped. While the lamp 20 is particularly well-suited for use in mines or similar work environments containing explosive gases, it will be understood that the principles of the present invention can be variously applied.

The lamp 20 includes means defining an elongated hand grip 22, an electric bulb 24, means 26 for supporting the bulb 24 within the hand grip 22, a transparent shield or tube 28, a tubular protector element 30, and conducting means 32 for routing electric current to the bulb 24 from a power source (not shown). The bulb 24 is elongated and arranged so as to extend generally axially or linearly of the hand grip 22. The transparent tube 28 is positioned about a substantial portion of the bulb 24 and arranged in an end-to-end relationship with the hand grip 22. As will be apparent herein, the tubular protector element 30 is positioned about the transparent tube 28 and cooperates with the hand grip 22 and tube 28 to maintain the tube 28 and hand grip 22 in the aforedescribed end-to-end relationship.

With reference still to FIG. 2, the hand grip 22 is hollow and elongated in shape and defines two opposite end portions 35,37. The end portions 35,37 terminate in planar ends 34,36, respectively, and hand grip 22 is generally cylindrical in form so as to provide a cylindrically-surfaced portion 38 extending between the ends 34,36. The grip 22 is relatively short in length, such as for example about five inches (13 cm) long, and relatively small in diameter, such as for example about two inches (5 cm) in diameter, as measured across the cylindrically-surfaced portion 38 so that the cylindrically-surfaced portion 38 can be easily grasped with one hand. Further defined by the hand grip 22 is a cylindrical interior surface 40 extending from one end 34 of the hand grip to the other end 36 thereof. While the grip end 34 is open for a reason apparent herein, the grip end 36 is capped by means of an end cap 42 joined to the grip end 36 by means of screws 44. The end cap 42 defines a central through-aperture 43 for a reason apparent herein. Although the hand grip 22 may be constructed out of many of a number of suitable materials, it is preferably constructed of a material having relatively high thermal conductivity, such as for example an aluminum alloy, for purposes of rapidly dissipating heat if any explosion happens to occur within the lamp 20. In the lamp 20, the hand grip 22 has been cast of aluminum 356-T6 as classified according to the Aluminum Association Standard.

With reference still to FIGS. 2–5, the electric bulb 24 is of a fluorescent type having a light-generating portion 25 and a current-receiving portion 27 associated with the light-generating portion 25. The light-generating portion 25 is generally U-shaped with the legs, indicated 48, of the U providing the bulb 24 with an elongate appearance. The ends of the legs 48 opposite the bend, indicated 49, of the U are operatively joined to the current-receiving portion 27. The current-receiving portion 27 includes a plug portion 50 and a pair of conducting pins 52 which are operatively joined to so as to extend from the plug 50. The plug portion 50 defines projections 51 (FIG. 5) on the sides thereof for a reason apparent herein. Furthermore, the bulb 24 is relatively short in overall length and is provided with the advantages (e.g., lower power requirements) normally associated with fluorescent lamps over incandescent bulbs so that the bulb 24 provides a relatively compact and efficient light source.

An example of a fluorescent lamp suitable for use as a bulb 24 is available from OSRAM Corporation, Newburgh, N.Y. under the trade designation DULUX compact fluorescent lamps. Although such lamps are available in a range of lamp wattages, a DULUX lamp rated at 13 watts has been found to be well-suited for use as the bulb 24. The light generated by the DULUX 13 watt lamp measures 900 lumens and is generated relatively uniformly over the length of the light-generating portion 25.

Figure 6:
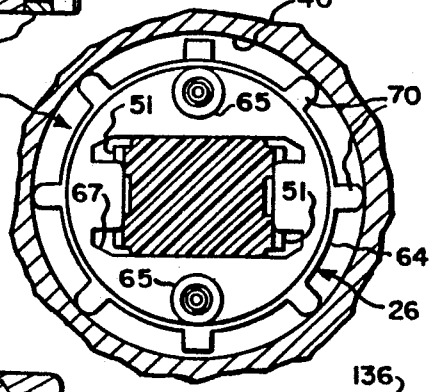
FIG. 6 is a cross-sectional view taken about on lines 6—6 of FIG. 2 with the bulb having been removed.

With reference to FIGS. 2, 6 and 7, the bulb-supporting means 26 of the lamp 20 is associated with the hand grip 22 for holding the bulb 24 within the grip 22. To this end, the bulb-supporting means 26 includes a receptacle member 56 positioned within the hollow interior of the hand grip 22 and adjacent the grip end 34. The receptacle member 56 includes a ring-like portion 65 having a pair of sockets 65 for receiving the pins 52 of the bulb 24, an opening 67 through which the plug portion 50 of the bulb 24 is positioned when the pins 52 are received by the sockets 65, and a pair of leg portions 66,66 extending from the ring-like portion 64. The opening of the ring-like portion 64 is sized so that when the plug 50 is inserted endwise therein the projections 51 (FIG. 5) defined on the sides thereof cooperate with the sides of the ring-like portion 64 so as to hold the plug 50 in a snug, snap-fit relationship with the receptacle member 56. Each leg portion 66 defines a foot 68 along the length thereof opposite the ring-like portion 64, and the receptacle member 56 is constructed of a resiliently flexible material, such as nylon or a suitable plastic. As best shown in FIG. 7, the receptacle member 56 is constructed or molded so that the legs 66,66 extend some somewhat radially outwardly of the ring-like portion 64, and are each capable of being flexed in the direction of the corresponding arrow A from the FIG. 7 solid-line condition to the FIG. 7 condition illustrated in phantom. Once flexed from the FIG. 7 solid-line to the FIG. 7 phantom-line condition, and for a reason apparent herein, the memory of the material out of which the receptacle member 56 is connected biases the legs 66 toward the FIG. 7 solid-line condition.

With reference again to FIG. 2, the bulb-supporting means 26 further includes a sleeve-like member 54 for cooperatively joining the receptacle member 56 to the hand grip 22. The sleeve-like end member 54 defines two opposite end portions 58,60 and a pair of diametrically-opposed openings 62 are defined in the sides of the member 54 adjacent the end 60. The sleeve-like member 54 is hollow and its end portion 58 is rigidly joined to the end cap 42 so that when the end cap 42 is operatively secured to the hand grip 22, as shown in FIG. 2, the sleeve-like member 54 extends generally axially through the interior of the grip 22. For purposes of sealing the space between the sleeve-like member 54 and the inside surface of the hand grip 22, the member 54 defines an outwardly-directed annular groove 59 in the end portion 58 and an O-ring 61 is operatively positioned within the groove 59.

With reference again to both FIGS. 2 and 7, the foot 68 of each leg portion 66 of the receptacle member 56 is adapted to be received by a corresponding opening 62 in the sleeve-like member 54. As mentioned earlier, the receptacle 56 is constructed of a resiliently flexible material, such as a Nylon, which permits the feet 68 of the leg portions 66 to be manually flexed toward one another from the FIG. 7 solid-line condition to the FIG. 7 phantom-line condition so that upon flexing the feet 68 as aforesaid, the feet 68 are biased away from one another. Therefore, upon appropriate flexing of the feet 68 toward one another to the FIG. 7 phantom-line condition and manipulation of the leg portions 66 into the end 58 of the sleeve-like member 54 so that the feet 68 are accepted by the openings 62 as shown in FIG. 2, the leg portions 66 are biased into engagement with the inner surface of the sleeve-like member 54 to interlock the receptacle member 56 with the member 54. Such an interlocking relationship between the receptacle member 56 and sleeve-like member 54 prevents the receptacle member 56 from rotating relative to the member 54 and hence the hand grip 22.

Furthermore and with reference again to FIGS. 2, 6 and 7, the receptacle member 56 includes a plurality of resilient fingers 70 joined to the ring-like portion 64, and the leg portions 66 define crooks 78 (FIG. 2). As the receptacle member 56 is viewed endwise as shown in FIG. 6*a*, the fingers 70 and crooks 78 project generally angularly radially outwardly of the ring-like portion 64 so as to contact the interior surface 40 of the hand grip 22. The receptacle member 56, with its fingers 70 and leg crooks 78, is sized so that when the receptacle member 56 is operatively positioned within the hand grip 22 as shown in FIG. 2, the fingers 70 and leg crooks 78 maintain the ring-like portion 64 generally centrally of the hand grip 22. It follows that while the fingers 70 maintain the ring-like portion 54 in a spaced relationship with the interior surface 40 of the hand grip 22, the leg portions 66 cooperate with the sleeve-like member 54 to maintain the receptacle member 56 in a predetermined position along the length of the hand grip 22.

The receptacle member 56 is advantageous in that its fingers 70 and leg crooks 78 provide means by which shock is absorbed if the lamp 20 is dropped or bumped, which shock may otherwise be transferred to the bulb 22. More specifically and if the lamp 20 is dropped or bumped, the fingers 70 and leg portions 66 flex in a manner which cushions the effect of the shock upon the bulb 24. Hence, the receptacle member 56 effectively intercepts and prevents the transference of shock from the hand grip 22 to the current-receiving portion 27 of the bulb 24.

Figure 3:
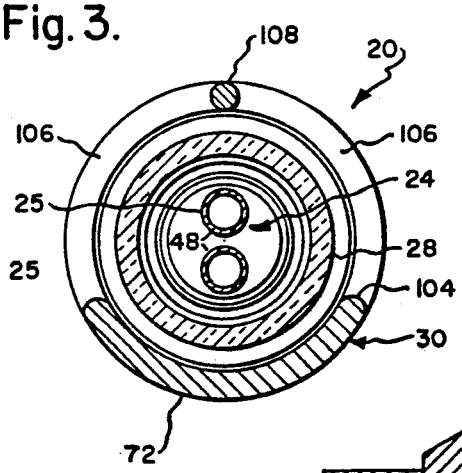
FIG. 3 is a cross-sectional view of the FIG. 1 lamp taken about on lines 3—3 of FIG. 1.

With reference to FIGS. 2 and 3, the transparent tube 28 is hollow and generally elongate in shape and positioned about the light-generating portion 25 of the bulb 24. The tube 28 defines two opposite end portions 80,82 which terminate in planar ends 84 and 86, respectively. Furthermore, the tube 28 is transparent to wavelengths of light in the visible range so that a substantial portion of light generated by the bulb 24 is transmitted through the walls of the tube 28. Accordingly, the tube 28 is constructed of a relatively clear material, such as glass. An exemplary glass material found to be well-suited for use as the tube 28 is a glass available from Owens-Illinois and classified as K33. The tube 28 defines a cylindrical inside surface 88 and is of such a size and shape that when positioned about the light-generating portion 25 of the bulb 24, the inside surface 88 of the tube 28 is spaced from the light-generating portion 25. Furthermore, the tube 28 is adapted to abut the hand grip end 34 in an end-to-end arrangement. Accordingly, the diameter of the inside surface of the tube 28 and the diameter of the interior surface 40 of the hand grip 22 are about the same.

In accordance with the present invention, the walls of the end portions 80,82 of the transparent tube 28 are relatively thick while the walls of the tube region, indicated 81, located intermediate of the end portions 80,82 and extending for a substantial distance along the length of the tube is relatively thin. As will be apparent herein, the relatively thick end portions 80,82 provide the end surfaces 84,86, respectively, with relatively large areas for purposes of sealing the tube 28 at the ends thereof. At the same time, however, the intermediate tube region 81 is reduced in wall thickness for the purpose of reducing the weight of the tube 28 and hence the overall weight of the lamp 20.

With reference to FIGS. 2 and 8, the lamp 20 includes a shock absorbing device 89 interposed between the light generating portion 25 of the bulb 24 and the inside surface 88 of the tube 28. More specifically, the shock absorbing device 89 includes a body having a ring-like portion 90 adapted to be snuggly received about the bend in the U of the light-generating portion 25 so as to snuggly encircle both legs 48 thereof and a lip portion 91 attached to the ring-like portion 90 so as to extend outwardly therefrom. Attached to the lip portion 91 so as to extend angularly and somewhat longitudinally of the bulb 24 are a plurality of fingers 93. The shock absorbing device 89 is comprised of a resiliently flexible material, such as Nylon or a suitable plastic, which provides the fingers 93 with a degree of flexibility and resiliency. If, therefore, the light-generating portion 25 is suddenly moved toward the inside surface 88 of the tube 28 or toward the cap portion 92, described herein, as a result of a sudden jarring of the lamp 20, the fingers 93 of the shock absorbing device 89 cushion the force of the shock by appropriately flexing when moved laterally into contact with the inside surface 88 or moved longitudinally into contact with the cap portion 92. Hence, the shock absorbing device 89 effectively intercepts and absorbs the shock of impact which may otherwise be transferred from the tube 28 to the light-generating portion 25 of the bulb 24.

The shock absorbing device 89 is further advantageous in that its position along the length of the light-generating portion 25 can be altered as desired. If, for example, it is desired to position two shock absorbing devices identical in construction to that of device 89 about the light-generating portion 25, both of the devices are placed one-at-a-time over the bend in the U of the light-generating portion 25 and then slidably moved relative to the light-generating portion 25 to a desired position therealong. One of such devices may be desired to be positioned generally midway along the length of the light-generating portion 25 while the other of the devices is positioned about the bend in the U thereof. Generally speaking, the more shock-absorbing devices 89 are positioned about the light-generating portion 25, the more the protection of the bulb 24 against the shock of impact of the lamp 20 is enhanced.

With reference to FIGS. 1-3, the tubular protector 30 includes an elongated sleeve-like body 72 defining a closed end 74 and an open end 76. The protector body 72 is generally cylindrical in shape as a path is traced from one of its ends 74 to the other end 76 and includes a cap portion 92, mentioned earlier, integrally joined to the remainder of the protector 30 so as to close the end 74. As best viewed in FIG. 2, the end cap portion 92 defines an interior surface 94 having a planar portion 95 which generally faces toward the open end 76 and defines an outer surface 96 in which is defined a boss 98. The boss 98 defines an opening 100 therein for receiving a hook 102. As best shown in FIG. 1, the hook 102 has a crooked upper portion 103 and a straight lower portion 105 which is securely held within the boss opening 100 so that the lamp 20 may be suspended by the hook 102.

In accordance with the present invention and with reference still to FIGS. 1–3, the tubular protector 30 defines an opening 104 in the side thereof and a plurality of ribs 106 extending generally across the opening 104. Furthermore and as best viewed in FIG. 3, the opening 104' extends a substantial distance around the body of the protector 30. The ribs 106 are spaced from one another and are each positioned in a plane oriented generally perpendicular to the longitudinal axis of the protector body, or in a radial plane of the protector body, so that the ribs 106 cooperate with the remainder of the protector to provide the protector 30 with its tubular or cylindrical appearance. Further, there extends along the length of the opening 104 a plurality of linearly-arranged struts 108 which join adjacent ribs 106 to one another and to opposite ends of the openings 104, as best shown in FIG. 1, and thereby enhance the strength of the ribs 106.

The ribs 106 are spaced relatively close together, such as for example about 0.75 inches (1.9 cm) apart, and are spaced a sufficient distance, such as for example about 0.25 inches (0.6 cm), from the outer surface of the transparent tube 28 to prevent many small-sized objects from coming into contract with the tube 28 if directed toward the opening 104 defined in the protector 30. Furthermore, the ribs 106 and struts 108 are integrally cast with the remainder of the protector 30 to form a one-piece unit. It is believed that because the length of the ribs 106 as measured across the opening 104 is significantly shorter than would be rod-like struts which may be arranged generally parallel to the longitudinal axis of the protector 30 so as to alternatively span the opening 104 (as is the case in the lamp shown and described in U.S. Pat. No. 4,156,893), the protector 30 is believed to be more economical to fabricate than one including such rod-like struts. Accordingly, the tubular protector 30 is believed to be partly responsible for the relatively inexpensive cost of making the lamp 20.

In accordance with the present invention, the tubular protector 30 cooperates with the hand grip 20 to maintain the transparent tube 28 in an end-to-end relationship with the hand grip 22. To this end and as best viewed in FIG. 2, the tubular protector 30 is internally threaded in the region adjacent the open end 76 so that the end 76 can be threadably secured to the external threads of the hand grip 22. Further, the planar portion 95 of the inner surface 94 of the protector 30 is positioned so as to face the tube end 84. It follows that when the tubular protector 30 is threaded upon the hand grip 22 to a tightened condition, the transparent tube 28 is tightly held between the cap portion 92 of the tubular protector 30 and the hand grip end 34. Once tightened to a desired extent upon the hand grip 22, the tubular protector 30 can be secured in place relative thereto by means of a set screw 107 (FIG. 2) extending through the wall of the protector 30 and engageable with the outside surface of the hand grip 22.

It will be understood that as the transparent tube 28 is tightly held as aforedescribed, the tube ends 84,86 are pressed toward one another to place the tube 28 in an end-to-end compressed or stressed condition. It is believed that such a compressed condition of the tube 28 is responsible for an enhanced strength of the tube 28 and a resistance to breakage if, for example, the exterior of the tube 28 were struck with an object or an explosion were to occur within the tube 28. It has been found that such an enhancement of tube strength by the aforedescribed compressed condition of the tube 28 enables the thickness of the tube wall to be reduced for purposes of reducing weight of the lamp yet the strength of the thinner-walled tube is still sufficient to satisfy many prescribed safety tests.

In the lamp 30, the transparent tube 28 is about 6.5 inches (16.5 cm) long, has end portions 80,82 having walls which are each 0.38 inches (0.95 cm) thick, and an intermediate region 81 having a wall which is about 0.19 inches (0.48 cm) thick. Furthermore, the cap portion 92 is tightened upon the hand grip 22 a sufficient amount to place forty to forty-five foot-pounds of end-to-end compression on the tube 28. It has been found that a tube 28 having such dimensions and compressed as aforesaid is strong enough to satisfy tube safety test outlined by Factory Mutual Research as discussed hereinafter.

It has also been found that the relatively thick walls of the tube end portions 80,82 are well-suited for withstanding what is believed to be a relatively direct pressure applied thereto by the end cap planar surface 95 and hand grip end 34, as the protector 30 is threaded or torqued into place upon the hand grip 22. Inasmuch as trasparent tubes of conventional lamps commonly include a glass tube of constant well-thickness and metal rings which are attached to the glass tube adjacent the ends thereof to thereby thicken the tube wall at the tube ends, it is not believed that the aforedescribed conventional tubes can withstand the same kind of pressure believed to be associated with the torquing of the protector 30 into place without damaging the tube end portions. Hence, the relatively thick-walled end portions 80,82 are believed to be advantageous in this respect.

For purposes of sealing the space between the abutting surfaces of the hand grip 22 and transparent tube 28, there is interposed between the tube end surface 82 and hand grip end 34 a ring-like gasket 109 comprised of suitable gasketing material, such as is available under the trade designation Blue Gylon from Garlozk, a subsidiary of Colt Industries. Similary, there is interposed between the interior surface 94 of the protector cap portion 92 the tube end surface 84, a ring-like gasket 110 comprised for example of gasketing material available under the trade designation Blue Gylon.

Figure 9:
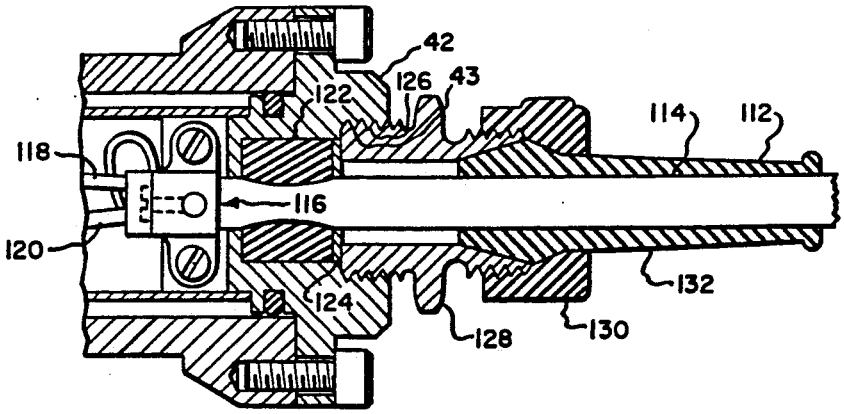
FIG. 9 is a cross-sectional view taken about on lines 9—9 of FIG. 1.

With reference to FIGS. 2 and 9, the conducting means 32 of the lamp 20 includes a power cord 112 operatively connected to the bulb 24 for routing electrical current from a power supply (not shown) to the bulb 24. The power cord 112 includes a cable portion 114 which extends axially through the aperture in the end cap 42 and held in place by means of a cable clamp assembly designated 116. The cable portion 114 includes two leads 118,120 which are each electrically connected to a corresponding one of the pins 52 of the bulb 24 through the sockets 65 of the receptacle member 56. In the axially-extending aperture 43 defined through the end cap 42 there is provided a packing element 122 having the shape of a relatively thick washer element of rubber or the like for providing a pressure type-packing around the cable portion 114. The packing element 122 serves to compress the cable portion 114 as shown in FIG. 4. A relatively thin-washer like element 124 is fitted on the cable portion 114 and adjacent the element 122. The end cap aperture 43 defines threads 126 extending from the outer end of the cap 42, and a metal connector element 128 is positioned about the cable portion 114. One end of the connector element 128 defines external threads for threadably accepting an internally threaded cap or closure element 130, and the other end of the connector element 128 defines external threads for securement within the end cap 42. Attached to the outer end of the connector element 128 is a cable strain relief bushing element 132 having a tapered outer surface. Collectively, the cable clamp assembly 16, packing element 112 and strain relief bushing 132 securely hold the cable portion 114 within the hand grip 22.

In accordance with the present invention, the lamp 20 includes a potting cement 166 positioned generally between the bulb 24 and the end 36 of the hand grip 22 which provides an effective firewall between the internal components of the lamp 20 and the hand grip end 36 through which is routed the power for the lamp 20. In the lamp 20 and as best shown in FIG. 2, the cement 166 is positioned within so as to substantially fill the hollow interior of the sleeve-like member 54 positioned within the hand grip 22. It follows that the leads 118,120 are embedded in the cement 166, and the amount of cement 166 is positioned substantially between the bulb 24 and the portion 114 of the power cord 112 entering the hand grip 22 through the end cap 42.

It has been found that a material which is well-suited for use as the cement 166 is a magnesite base cement available under the trade designation Plastic Porcelain No. 30 from Sauereisen Cements Company, Pittsburgh, Pa. Plastic Porcelain No. 30 is an inorganic (i.e., magnesium oxide) cold plastic cement supplied in power form for mixing with water. The mixture cures in a chemical setting action and hardens like porcelain. When cured, the Plastic Porcelain No. 30 resists electricity and is dimensionally stable to 900° Fahrenheit (482° Centigrade). Hence, the cement 166 provides an effective firewall between the interior of the lamp 20 and the portion of the power cord 112 entering the lamp 20, provides an effective insulator between the power cord leads 118,120 and the hand grip 22 and provides positional stability for the portion of the leads 168,120 positioned within the hand grip 22. For purposes of satisfying industrial standards set for explosion-proof lamps, a length (e.g. one-fourth of an inch) of the insulation of the leads 118,120 which is embedded within the cement 166 is stripped from the wire thereof.

Figure 10:
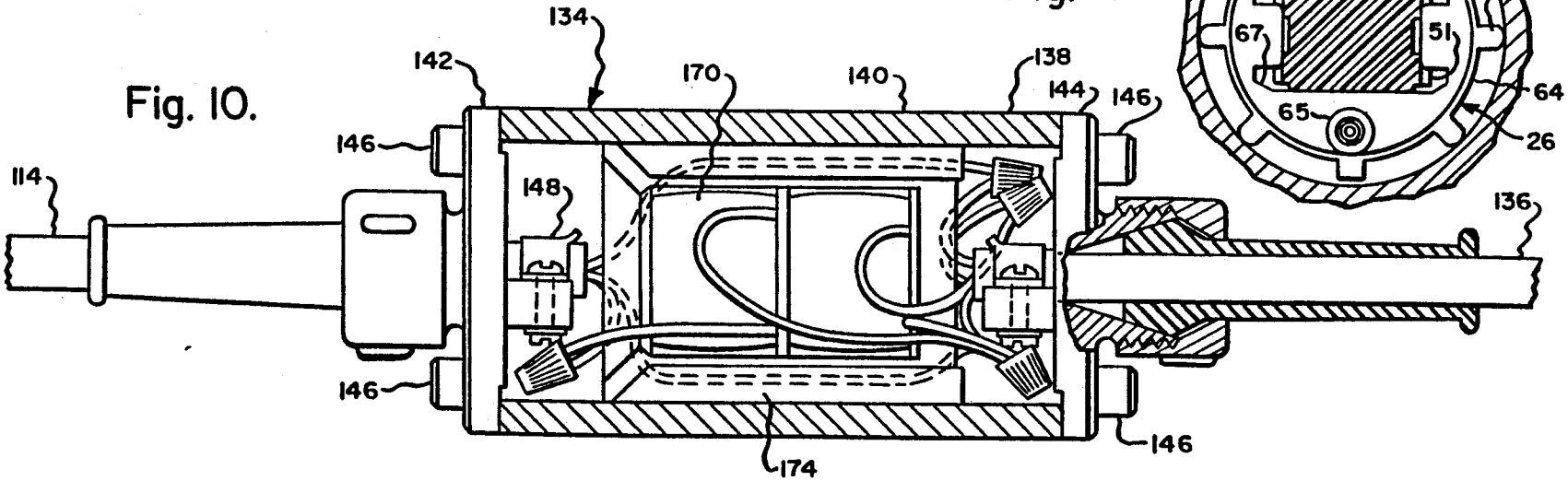
FIG. 10 is a cross-sectional view taken about on lines 10—10 of FIG. 1.

With reference to FIGS. 1, 10 and 11, the conducting means 28 further includes a ballast assembly 134 operatively joined within the power cord 112. As best shown in FIG. 1, the power cord portion 114 of relatively long length is connected between the hand grip 22 and ballast assembly 134 to physically separate the hand grip 22 and ballast assembly 134. If, therefore, a explosion were to occur within or about the light-transmitting portion of the lamp damage spawned at the site of the ballast from the explosion is likely to be circumvented. With reference still to FIG. 10, the ballast assembly 134 is connected electrically in the power cord 112 or cable between the cable portion 114 connected to the lamp 20 and another cable portion, indicated 136, which is connected to an explosion proof plug 168 for connection to a standard electrical supply outlet (not shown) when the lamp 20 is in use. The ballast assembly 134 includes a ballast 170 which is housed in a housing 138 comprised of a hollow, preferably cylindrical portion 140 of metal, such as aluminum 356-T6. The housing 138 is closed by a pair of end closure elements 142, 144 which are preferably disc-shaped. The end closure elements 142, 144 can be secured in place by suitable means, such as screw-type fasteners 146 which extend through the elements 142, 144 adjacent the periphery thereof and into the wall of the housing portion 140.

With reference to FIGS. 10 and 11, cable portion 144 extends through end closure element 142 and is held in place by a clamp 148 secured by a screw 150 and an extension 152 defined on the inner surface of closure element 142. Similarly, cable portion 136 extends through end closure element 144 and is held in place by a clamp 154 secured by a screw 156 and an extension 158 defined on the inner surface of closure element 144. The leads of the cable portion 114 and the leads of the cable portion 136 are electrically connected within the ballast assembly 134 in accordance with the diagram of FIG. 11. Alternatively and with reference to FIG. 12, the leads of the cable portion 114 and 136 can be electrically connected to an alternative or "isolated" ballast assembly, indicated 172, in accordance with the diagram of FIG. 12. The manner in which case each of the FIG. 11 ballast assembly 134 and the FIG. 12 ballast assembly 172 is connected within the power cord 112 is well-known in the art. For a more detailed description of the manner in which the "isolated" ballast assembly 172 is wired with the lamp power cord, reference may be had to U.S. Pat. No. 4,156,893 incorporated herein by reference.

In accordance with the present invention and with reference again to FIG. 10, the ballast 170 of the ballast assembly 134 is encased within an electrically-insulative potting cement 174. It has been found that the aforementioned Plastic Porcelain No. 30 from Saiereisen Cements Company is well-suited for use as a potting cement 174 and, unlike commonly-used polyurethane epoxy, will pass current material compatibility tests set forth by Factory Mutual Research in a connection with explosion-proof electrical equipment.

To turn the lamp 20 ON, the explosion-proof plug 168 (FIG. 1) is operatively connected to a standard electrical supply outlet (not shown). The lamp 20 can then be held by means of the hand grip 22 and disposed in such a manner that light emitted from the bulb 24 illuminates a selected region. Of course, the hook 102 can be utilized to support the lamp 20 when the lamp 20 is used or when stored.

The aforedescribed sealed construction of the lamp 20 makes it particularly well-suited for use in regions containing combustible and explosion gases. The cooperation between the gasket 109, hand grip end 34 and tube end surface 82, between the gasket 110, tube end surface 84 and protector cap portion 92, and between the O-ring 61, sleeve-like member 58 and the interior surface 40 of the hand grip 22 provide a gas-tight enclosure of the interior of the lamp 20.

In addition to the gas-tight enclosure of the lamp 20, the construction of the lamp 20 accommodates a quick disassembly and reassembly of the lamp 20 if a replacement of bulb 24 is necessary. To replace the bulb 24, the screws 44 are removed from the end cap 42 and the end cap 42 is removed from the hand grip 22. Because the sleeve-like member 54 is fixedly attached to the end cap 42, and the receptacle member 36 is connected to the member 54 and receptacle member 36 are removed as a unit with the end cap 42 as the end cap 42 is moved away from the hand grip 22. It follows that removal of the cap 42 withdraws the bulb 24 with the receptacle member 36 through the hand grip 22 to expose the bulb 24 to the user. The bulb 24 can then be withdrawn from the receptacle member 36 and replaced with another bulb of like construction. To reassemble the lamp 20, the replacement bulb and sleeve-like member 36 are sequentially directed endwise through the hand grip end 36 and the end cap 42 reattached to the hand grip 22 with the screws 44. Preferably the screws 44 are tightened, or retightened as the case may be, to about twenty inch-pounds of torque.

As mentioned earlier, the lamp 20 possesses a construction capable of satisfying current safety standards relating to explosion proof lamps. To date, the lamp 20 has passed sufficient safety standards established by Factory Mutual Research of Norwood, Mass. and directed to explosion-proof electrical equipment, as published under class number 3615 and dated Jan. 1, 1979, to qualify as Class I, Div. 1 and 2, Group C and D; Class I, Div. 1 and 2, Group E,F, and G; and Class II, Div. 1 and 2. The term explosion-proof for purposes of the standards set by Factory Mutual Research is defined by Article 500 of the National Electrical Code.

It follows from the foregoing that the lamp 20 accomplishes its intended objects. The lamp 20 is of sturdy, explosion-proof construction to resist damage if dropped or bumped and includes shock absorbing devices in the form of the receptacle member 56 and a bulb-receiving device 90 for enhancing the protection of the bulb 24 against the effects of shock to which the outer surface of the lamp 20 could be exposed. Furthermore, the overall length of the lamp 20 is relatively short so that the lamp 20 can be manipulated into small areas, and the lamp is relatively light in weight. Still further, the incorporation of the insulative cement 166 and 170 in the hand grip 22 and ballast assembly 134, respectively, is believed to reduce any likelihood that damage from an explosion within the lamp 20 could be compounded by exposure to the power cord 112 or ballast 170.

It will be understood that numerous modifications and substitutions can be had to the aforedescribed embodiment 20 without departing from the spirit of the invention. For example, although the bulb 24 of the aforedescribed lamp 20 has been shown and described as including a light-generating portion 25 in the form of a U having one pair of legs 48, an alternative bulb could be used. For example, there is shown in FIGS. 13–15 an alternative bulb 176 for utilization in a lamp in accordance with the present invention. Such a bulb 176 includes a plug-like current-receiving portion 178 and a light-generating portion including a pair of U-shaped tubes 180 operatively joined to the plug-like portion 178. The bulb 176 is rated at 26 Watts and may be preferred over the bulb 24 of the lamp 20 in instances where more light per linear unit of bulb length is required. A bulb corresponding to the bulb 176 of FIGS. 13–15 is available from OSRAM Corporation under the trade designation DULUX D Super-Compact Fluorescent Lamp.

As best shown in FIG. 14, the plug-like portion 178 includes two pins 182 for receiving current from a power source but is dissimilar in cross section to that of the plug-like portion 50 of bulb 24 as best shown in FIG. 5. Accordingly, a receptacle member constructed to accept the plug-like portion 50 must possess an alternative construction (i.e., having a ring portion having a different-stud opening) to that of receptacle member 56 of the lamp 20. Furthermore, in order to protect the light-generating portion, indicated 177, of the bulb 176 from exposure to impact or shock effects, shock absorbing means 184 (FIG. 14) possessing an alternative construction to that of shock absorbing device 90 (FIG. 8) is positioned about the bulb 176. For example and with reference to FIG. 14, such shock absorbing means 184 can take the form of two devices 186 each having a ring-like portion 188 adapted to be snuggly received about a corresponding pair of tubes 180 of the light-generating portion 177 and a plurality of fingers 190 extending from the ring-like portion 188 as shown in FIG. 13 and 14. Accordingly, the aforedescribed lamp embodiment 20 is intended for the purpose of illustration and not as limitation.

What is claimed is:

1. A portable electric lamp comprising:

an elongated fluorescent electric bulb having a current-receiving portion at an end of the bulb and a generally U-shaped light-generating portion operatively joined to said current-receiving portion so that the light emitted by said bulb is relatively great as measured per unit length of said light-generating portion;

means defining an elongated hand grip having two opposite ends;

means associated with the hand grip for supporting the bulb at one end of the hand grip, the bulb-supporting means adapted to cooperate with the current-receiving portion of the electric bulb and to thereby maintain the bulb in such a relationship with the hand grip that the light-generating portion of the bulb extends generally axially of and from said one end of the hand grip;

an elongated transparent tube held in position about the light-generating portion of the electric bulb and which is transparent to light generated thereby;

conducting means operatively connected to said bulb-supporting means for routing current from a power source to the current-receiving portion of the bulb; and shock-absorbing means associated with said bulb and adapted to intercept shock to which at least one of the hand grip and transparent tube is exposed to thereby prevent the transference of shock from said one of the hand grip and the transparent tube to the bulb, said shock absorbing means including a ring-like boby snuggly encircling said U-shaped portion of said bulb and a plurality of resiliently flexible fingers extending generally outwardly of said ring-like body for maintaining a spacing between the interior of said one of the hand grip and the transparent tube and the bulb and for cushioning the effect of shock which may otherwise be transferred to the bulb from said one of the hand grip and the transparent tube, said shock-absorbing means being slidable lengthwise along said bulb portion.

2. A protable electric lamp comprising: an elongated electric bulb having a light-generating portion and a current-receiving portion at an end of the bulb;

means defining an elongated hand grip having two opposite ends;

means associated with the hand grip for supporting the bulb at one end of the hand grip, the bulb-supporting means adapted to cooperate with the current-receiving portion of the electric bulb and to thereby maintain the bulb in such a relationship with the hand grip that the light-generating portion of the bulb extends generally axially of and from said one end of the hand grip;

an elongated transparent tube held in position about the light-generating portion of the electric bulb and which is transparent to light generated thereby;

conducting means operatively connected to said bulb-supporting means for routing current from a power source to the current-receiving portion of the bulb; and shock-absorbing means associated with said bulb and adapted to intercept shock to which at least one of the hand grip and transparent tube is exposed to thereby prevent the transference of shock from said one of the hand grip and the transparent tube to the bulb, said shock-absorbing means including a ring-like body snuggly encircling a portion of said bulb and a plurality of resiliently flexible fingers extending generally outwardly of said ring-like body for maintaining a spacing between the interior of said one of the hand grip and the transparent tube and the bulb and for cushioning the effect of shock which may otherwise be transferred to the bulb from said one of the hand grip and the transparent tube, said elongated bulb having a longitudinal axis and said resiliently flexible fingers extending generally outwardly from said ring-like body in an angular relationship with respect to said longitudinal axis, said body of said shock absorbing means being slidable lengthwise along said bulb for adjusting the location of said shock absorbing means therealong and for accommodating additional shock absorbing means on said bulb.

* * * * *